US010295256B2

(12) United States Patent
Jadhav et al.

(10) Patent No.: US 10,295,256 B2
(45) Date of Patent: May 21, 2019

(54) DISHWASHER, A DOOR ASSEMBLY FOR THE DISHWASHER, AND AN ASSOCIATED METHOD FOR DRYING DISHWARE

(71) Applicant: ELECTROLUX HOME PRODUCTS, INC., Charlotte, NC (US)

(72) Inventors: Ashwin Jadhav, New Bern, NC (US); Jeffrey E. Nelson, Kinston, NC (US); Dennis A. Poyner, Kinston, NC (US); Van P. Beck, Shepherdsville, KY (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 345 days.

(21) Appl. No.: 14/173,121

(22) Filed: Feb. 5, 2014

(65) Prior Publication Data

US 2014/0150286 A1 Jun. 5, 2014

Related U.S. Application Data

(63) Continuation-in-part of application No. 12/365,625, filed on Feb. 4, 2009, now Pat. No. 8,696,824.

(51) Int. Cl.
*A47L 15/48* (2006.01)
*F26B 21/00* (2006.01)
(Continued)

(52) U.S. Cl.
CPC ..... *F26B 21/004* (2013.01); *A47L 15/0034* (2013.01); *A47L 15/4257* (2013.01);
(Continued)

(58) Field of Classification Search
CPC ..... A47L 2401/19; A47L 2501/10; A47L 2501/12; A47L 15/0034; A47L 15/488
See application file for complete search history.

(56) References Cited

U.S. PATENT DOCUMENTS 3,616,810 A 11/1971 Bush
3,658,075 A 4/1972 Jacobs
(Continued)

FOREIGN PATENT DOCUMENTS

CA 2187993 4/1997
CH 683819 5/1994
(Continued)

OTHER PUBLICATIONS

Hudson,The Basics of Axial Flow Fans, 2000, Hudson, Fig.1, paragraph discusing blade passing frequency.*
(Continued)

*Primary Examiner* — Marc Lorenzi
(74) *Attorney, Agent, or Firm* — Alston & Bird LLP

(57) ABSTRACT

A dishwasher, a door assembly for the dishwasher and a method of drying the dishware in the dishwasher are provided. The dishwasher may include a tub portion adapted to hold dishware. The dishwasher may also include a duct having an inlet proximate to the top of the tub portion. The duct may be configured to receive warm air and vaporized water from within the tub portion. The dishwasher may further include a single blower configured to direct the warm air and vaporized water into the duct during a drying cycle. The blower may be configured to operate in a cyclic manner. In various embodiments, the blower may be configured to operate in a reverse direction for at least a portion of the drying cycle.

4 Claims, 15 Drawing Sheets

(51) Int. Cl.
*A47L 15/00* (2006.01)
*A47L 15/42* (2006.01)

(52) U.S. Cl.
CPC ..... *A47L 15/483* (2013.01); *A47L 15/488* (2013.01); *A47L 2301/08* (2013.01); *A47L 2401/04* (2013.01); *A47L 2401/10* (2013.01); *A47L 2401/19* (2013.01); *A47L 2501/05* (2013.01); *A47L 2501/10* (2013.01); *A47L 2501/11* (2013.01); *A47L 2501/12* (2013.01); *A47L 2501/20* (2013.01); *A47L 2501/30* (2013.01)

(56) References Cited

U.S. PATENT DOCUMENTS

| | | | | |
|---|---|---|---|---|
| 3,807,420 | A | 4/1974 | Donselman et al. | |
| 3,908,681 | A | 9/1975 | Schimke et al. | |
| 4,179,307 | A | 12/1979 | Cau et al. | |
| 5,056,543 | A | 10/1991 | Dygve | |
| 5,277,210 | A | 1/1994 | Kim | |
| 5,337,500 | A | 8/1994 | Enokizono | |
| 5,355,900 | A | 10/1994 | Sakata | |
| 5,660,195 | A | 8/1997 | Taylor, Jr. et al. | |
| 5,797,409 | A | 8/1998 | Cooper et al. | |
| 5,806,541 | A | 9/1998 | Cooper et al. | |
| 5,875,802 | A | 3/1999 | Favaro et al. | |
| 5,881,746 | A | 3/1999 | Buser et al. | |
| 5,960,804 | A | 10/1999 | Cooper et al. | |
| 6,622,754 | B1 | 9/2003 | Roth et al. | |
| 6,694,990 | B2 | 2/2004 | Spanyer et al. | |
| 7,093,604 | B2 | 8/2006 | Jung et al. | |
| 7,216,654 | B2 | 5/2007 | Kang | |
| 7,222,439 | B2 | 5/2007 | Paintner | |
| 7,524,380 | B1 | 4/2009 | Duri et al. | |
| 7,695,572 | B2 | 4/2010 | Ahn et al. | |
| 7,767,029 | B2 | 8/2010 | Lee | |
| 7,798,157 | B2 | 9/2010 | Kim | |
| 7,875,122 | B2 | 1/2011 | Gonska et al. | |
| 8,757,179 | B2 | 6/2014 | Wetzel et al. | |
| 2003/0079760 | A1 | 5/2003 | Spanyer et al. | |
| 2003/0140517 | A1 | 7/2003 | Schmid | |
| 2006/0042658 | A1 | 3/2006 | Engler | |
| 2006/0185190 | A1 | 8/2006 | Classen et al. | |
| 2006/0231122 | A1 | 10/2006 | Stelzer et al. | |
| 2006/0236556 | A1* | 10/2006 | Ferguson | A47L 15/0034 34/73 |
| 2007/0006898 | A1* | 1/2007 | Lee | A47L 15/0034 134/10 |
| 2007/0089763 | A1 | 4/2007 | Paintner | |
| 2007/0102026 | A1* | 5/2007 | Ahn | A47L 15/0049 134/25.2 |
| 2007/0240738 | A1 | 10/2007 | Heissler et al. | |
| 2007/0251552 | A1 | 11/2007 | Lee | |
| 2007/0261721 | A1 | 11/2007 | Eiermann et al. | |
| 2008/0006308 | A1 | 1/2008 | Classen et al. | |
| 2008/0072935 | A1 | 3/2008 | Han et al. | |
| 2008/0087307 | A1 | 4/2008 | Han et al. | |
| 2008/0264455 | A1 | 10/2008 | Brewer et al. | |
| 2008/0264458 | A1 | 10/2008 | Berner et al. | |
| 2009/0038653 | A1 | 2/2009 | Kang | |
| 2009/0056769 | A1 | 3/2009 | Han et al. | |
| 2009/0095332 | A1 | 4/2009 | Lee | |
| 2010/0083991 | A1 | 4/2010 | Tolf | |
| 2010/0192977 | A1 | 8/2010 | Jadhav et al. | |
| 2011/0126864 | A1* | 6/2011 | Kim | A47L 15/486 134/25.2 |
| 2012/0055519 | A1 | 3/2012 | Hong et al. | |
| 2013/0125411 | A1 | 5/2013 | Dreossi et al. | |
| 2013/0146091 | A1 | 6/2013 | Dreossi et al. | |

FOREIGN PATENT DOCUMENTS

| | | | | |
|---|---|---|---|---|
| CH | 683819 | A5 | 5/1994 | |
| CN | 1374068 | A | 10/2002 | |
| CN | 101052339 | A | 10/2007 | |
| CN | 102368943 | A | 3/2012 | |
| DE | 128108 | A1 | 11/1977 | |
| DE | 30 38 080 | A1 | 5/1982 | |
| DE | 4230576 | A1 * | 3/1994 | A47L 15/486 |
| DE | 195 38 580 | | 4/1997 | |
| DE | 198 06 700 | A1 | 8/1999 | |
| DE | 19946456 | A1 | 4/2001 | |
| DE | 10 2007 019 298 | A1 | 10/2007 | |
| DE | 10 2008 017 597 | A1 | 10/2009 | |
| EP | 0239012 | A1 | 9/1987 | |
| EP | 0 486 828 | A1 | 5/1992 | |
| EP | 0556773 | B1 | 6/1996 | |
| EP | 0 721 762 | | 7/1996 | |
| EP | 1127532 | A2 | 8/2001 | |
| EP | 0721762 | B1 | 7/2002 | |
| GB | 2 026 147 | A | 1/1980 | |
| GB | 2274772 | A | 8/1994 | |
| GB | 2 308 431 | A | 6/1997 | |
| JP | 10-258014 | | 9/1998 | |
| JP | 2003038407 | | 2/2003 | |
| JP | 2005253569 | | 9/2005 | |
| KR | 20100094387 | A * | 8/2010 | |
| WO | WO 2005/051160 | A1 | 6/2005 | |
| WO | WO 2006/080707 | | 8/2006 | |
| WO | WO 2008/0101673 | A1 | 8/2008 | |
| WO | WO2008101673 | A1 * | 8/2008 | A47L 15/48 |
| WO | WO 2011/147683 | A1 | 12/2011 | |
| WO | WO 2011-147700 | A1 | 12/2011 | |

OTHER PUBLICATIONS

Prakashan, Electricity, Magnetism and Electromagnetic Theory, 2004, tittle page, problem 6, first line of 4.272.*
KR20100094387—Machine Translation (Year: 2010).*
DE4230576—Machine Translation (Year: 1994).*
International Search Report and Written Opinion for International Application No. PCT/US2010/023161 dated Dec. 27, 2010.
Search Report for Chinese Application No. 201080014396.5; dated Apr. 22, 2013.
Supplemental Search Report for Chinese Application No. 201080014396.5; dated Nov. 14, 2013.
United States Patent and Trademark Office, Office Action for U.S. Appl. No. 14/188,163, dated Mar. 9, 2017, 14, pages, U.S.A.
United States Patent and Trademark Office, Office Action for U.S. Appl. No. 14/188,163, dated Jun. 30, 2017, 10, pages, U.S.A.
United States Patent and Trademark Office, Office Action for U.S. Appl. No. 14/188,163, dated Aug. 10, 2016, 16, pages, U.S.A.

* cited by examiner

DISHWASHER, A DOOR ASSEMBLY FOR THE DISHWASHER, AND AN ASSOCIATED METHOD FOR DRYING DISHWARE

RELATED APPLICATIONS

This application is a continuation-in-part of and claims the benefit of U.S. patent application Ser. No. 12/365,625, entitled "Dishwasher, A Door Assembly for the Dishware, and An Associated Method for Drying Dishware," filed Feb. 4, 2009, the contents of which are incorporated herein by reference in its entirety.

BACKGROUND

Field of the Invention

The present invention generally relates to dishwashers and, more particularly, to drying systems of dishwashers and associated methods thereto.

Description of Related Art

A dishwasher typically employs a series of cycles for cleaning dishware disposed within a tub portion of the dishwasher. One particular cycle, a drying cycle, is normally reserved as the final step in the cleaning process, the drying cycle is used to remove residual water from the dishware after the wash and rinse cycles are complete. Dishware is typically stacked vertically in upper and lower dish racks within the tub portion such that a substantial amount of the water used during a wash/rinse cycle runs off the dishware toward the bottom of the tub portion for collection in a sump. By such stacking, the amount of water collecting on the dishware is reduced or minimized (i.e., water is less likely to collect in the bowls, plates, cups, etc.).

Nevertheless, some residual water remains on the dishware (normally due to surface tension) and must be removed by employing the drying cycle. To that end, the dishwasher typically includes a heat source to warm the air that is forced into and circulated within the tub portion, wherein the heated air absorbs the residual water remaining on the dishware, resulting in humid air/moisture stagnating within the dishwasher to a point of saturation. At predetermined intervals, as usually determined when a humidity sensor measures a threshold level, the humid air is evacuated from within the tub portion, and the heat source again generates heated air to further dry the dishware, typically until the humidity sensor measures a predetermined moisture level signaling that further drying is not required. Often, these systems are somewhat ineffective in that the residual water is not completely removed from the dishware, and a "hand-dry" step is further needed to remove such residual water (e.g., a hand-towel is often used to remove residual water spots), much to the dissatisfaction of the user. Thus, the drying performance of such systems is limited, causing additional time to be needed once the dishwashing process has completed. That is, the user is not able to directly move the dishware from the dishwasher to cabinetry for storage due to the need for an additional drying step.

Accordingly, an improved drying system for a dishwasher and associated method may be desirable.

BRIEF SUMMARY

Embodiments of the present invention address the above by providing a method of drying dishware in a tub portion of a dishwasher, a dishwasher, and a door assembly for a dishwasher. For example, according to an embodiment, a method of drying dishware in a tub portion of a dishwasher is provided. The dishwasher may comprise a tub defining an opening and an interior, a door attached to the tub and configured to selectively permit access to the interior of the tub, a duct positioned within the door and having an inlet that is in fluid communication with the interior of the tub, and a blower in fluid communication with the duct and the tub. The method may include initiating operation of a blower during a drying cycle of the dishwasher and cyclically actuating the blower during a drying cycle to direct warm air and vaporized water from the tub into the duct to facilitate condensation of the vaporized water as the warm air and vaporized water travel through the duct.

In other embodiments, the duct defines a tortuous path to enhance condensation of the vaporized water. The duct may define an outlet in fluid communication with an external environment, such that cyclically actuating the blower enables ambient air from the external environment to enter the duct via the outlet to interact with the vaporized water within the duct to accelerate the condensation of the vaporized water. In various embodiments, the blower defines a single fan.

In various embodiments, the method may further comprise reversing the direction of operation of the blower during the drying cycle. In such embodiments, the duct may define an outlet in fluid communication with an external environment such that reversing the direction of operation of the blower draws ambient air from the external environment into the duct via the outlet to interact with the vaporized water within the duct to accelerate the condensation of the water vapor. In such embodiments, the blower may define a single fan. Thus, in some embodiments, the ambient air from the external environment may be drawn into the outlet of the duct by the same blower configured to draw the warm air and vaporized water into the inlet of the duct.

In another embodiment, a dishwasher is provided. The dishwasher may include a tub defining an opening and an interior, a door attached to the tub and configured to selectively permit access to the interior of the tub; a duct positioned within the door and having an inlet that is in fluid communication with the interior of the tub, and a blower configured to direct the warm air and vaporized water into the duct during a drying cycle of the dishwasher. The blower may be configured to operate in a cyclic manner during the drying cycle.

In various embodiments, the duct extends from the inlet to an outlet and is configured to facilitate condensation of the vaporized water as the warm air and vaporized water travel from the inlet toward the outlet. The outlet may be in fluid communication with an external environment such that the operation of the blower in the cyclic manner enables ambient air from the external environment to enter the duct via the outlet to interact with the vaporized water within the duct to accelerate the condensation of the vaporized water. In various embodiments, the blower defines a single fan.

In various embodiments, the blower may be configured to reverse direction of operation during the drying cycle. In some such embodiments, the outlet may be in fluid communication with an external environment such that reversing the direction of operation of the blower draws ambient air from the external environment into the duct via the outlet to interact with the vaporized water within the duct to accelerate the condensation of the vaporized water. In various embodiments, the blower defines a single fan. In some embodiments, the ambient air from the external environment may be drawn into the outlet of the duct by the same blower configured to draw the warm air and vaporized water into the inlet of the duct.

Another example embodiment provides a door assembly for selectively permitting access to a tub of a dishwasher. The door assembly may include an inner wall, an outer wall, a duct extending between the inner wall and the outer wall from on inlet to an outlet, and a blower configured to draw warm air and vaporized water into the inlet of the duct from the tub during a drying cycle of the dishwasher. The duct may at least partially define a tortuous path that is configured to facilitate condensation of vaporized water from warm air as the warm air and vaporized water are directed through the duct from the inlet toward the outlet. The blower may be configured to operate in a cyclic manner.

In various embodiments, the outlet is in fluid communication with an external environment such that the operation of the blower in the cyclic manner enables ambient air from the external environment to enter the duct via the outlet to interact with the vaporized water within the duct to accelerate the condensation of the vaporized water. In some embodiments, the blower may define a single fan.

In various embodiments, the blower may be configured to reverse direction of operating during the drying cycle. In some such embodiments, the outlet is in fluid communication with an external environment such that reversing the direction of operation of the blower draws ambient air from the external environment into the duct via the outlet to interact with the vaporized water within the duct to accelerate the condensation of the vaporized water. In various embodiments, the ambient air from the external environment is drawn into the outlet of the duct by the same blower configured to draw the warm air and vaporized water into the inlet of the duct.

BRIEF DESCRIPTION OF THE SEVERAL VIEWS OF THE DRAWING(S)

Having thus described embodiments of invention in general terms, reference will now be made to the accompanying drawings, which are not necessarily drawn to scale, and wherein:

DETAILED DESCRIPTION OF PREFERRED EMBODIMENTS OF THE PRESENT INVENTION

The present invention now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements Like numbers refer to like elements throughout.

Figure 1:
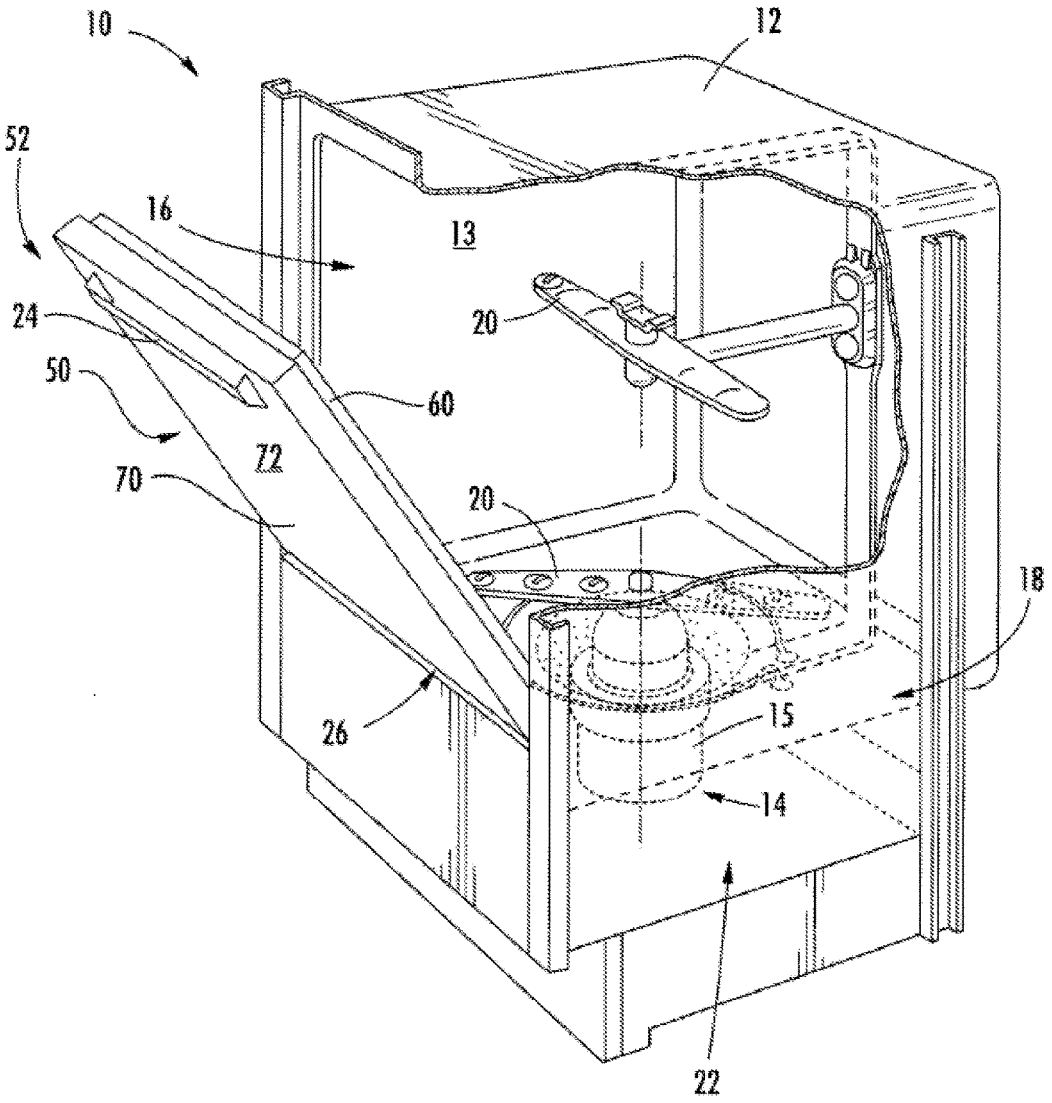
FIG. 1 is a perspective view of a dishwasher of a type suitable for use with various embodiments of the present invention.

FIG. 1 illustrates an example of a dishwasher 10 that may benefit from various embodiments of the present invention. The dishwasher 10 may include a tub portion 12 (partly broken away in FIG. 1 to show internal details) having a door assembly 50 and a plurality of walls 13 that together form an enclosure in which dishes, utensils, and other dishware may be placed for washing. The tub portion 12 may also define a forward access opening, generally designated as 16. As known in the art, the dishwasher 10 may also include slidable lower and upper racks (not shown) for holding the dishes, utensils, and other dishware to be washed. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18 of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

The door assembly 50 may be pivotably engaged with the tub portion 12 about the lower end 18 thereof so as to selectively permit access to the interior of the tub portion 12. That is, a lower edge 26 of the door assembly 50 may be pivotably engaged (e.g., hinged) with the lower end 18 of the tub portion 12 such that the door assembly 50 is pivotable about the lower edge 26 thereof to cover and seal the forward access opening 16 in a closed position when the dishwasher 10 is in operation, and to provide access to the interior of the tub portion 12 through the forward access opening 16 when the door assembly 50 is pivoted from the closed position to an opened position. In some instances, the door assembly 50 may comprise an inner wall 60 and an outer wall 70. The door assembly 50 may include a handle member 24 disposed on an outer surface 72 of the outer wall 70, to provide the user with a grasping portion.

Embodiments of the present invention generally relate to a drying system of the dishwasher configured to help remove moisture from the dishwasher during a drying cycle so as to help dry the dishware disposed in the tub portion. According to an embodiment of the present invention, the drying system may be generally disposed within the door assembly of the dishwasher. For example and as illustrated in FIGS. 2 through 5, the drying system 200 may include a blower 210 (e.g., a centrifugal blower) and a duct 220, both of which may be positioned in the door assembly of the dishwasher.

More specifically, the blower 210 may positioned proximate the top of the door assembly 250 such that an inlet 212 of the blower is disposed on an interior wall or other interior portion of the door assembly 250. In such a position, the blower 210 is configured to draw or force air, such as the moist air during a drying cycle, from the tub portion toward the duct 220 inside of the door assembly 250. The inlet 212 may include a plurality of louvered fins (not visible in FIGS. 2 through 4) forming a barrier to minimize water (from spray or in the form of airborne droplets) from being pulled into the blower 210. As discussed further herein, in addition to the blower 210, the dishwasher may include a heating device or element (not visible in FIGS. 2 through 4) configured to heat the air within the tub portion. Heating the air causes the air to rise toward the upper end of the tub portion and toward the blower 210.

Figure 2:
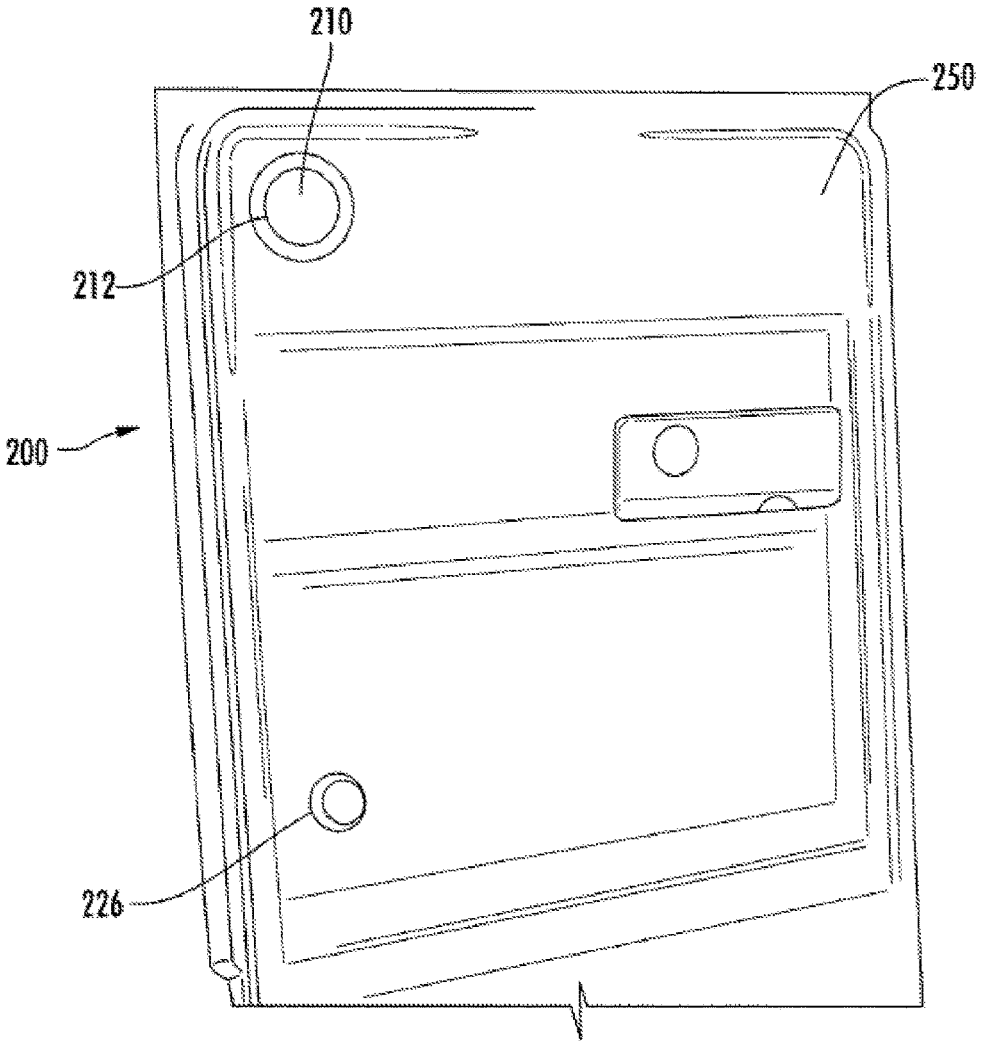
FIG. 2 is a view of an inner facing side of the inner wall of a door assembly consistent with an exemplary embodiment of the present invention.
Figure 3:
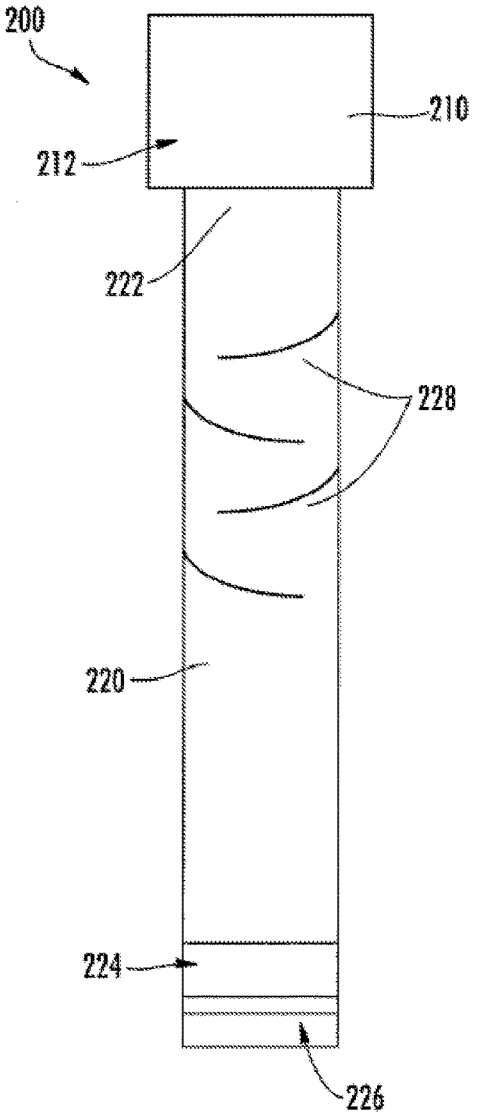
FIG. 3 is a view of an outer facing side of the inner wall of FIG. 2 wherein a portion of an inlet end of a duct is removed to illustrate the blower.
Figure 4:
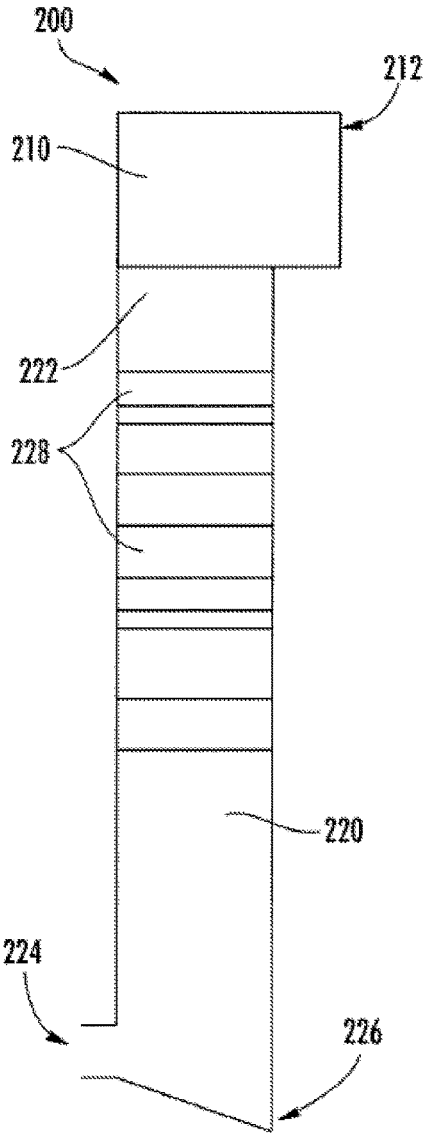
FIG. 4 is a view of the outer facing side of the inner wall of FIG. 3 illustrating more of the duct.

The duct 220 may extend from an inlet end 222 to an outlet end 224 in the door assembly between an inner wall and an outer wall of the door assembly. The inlet end 222 of the duct may be communication with the blower 210 such that as the moist air is drawn out of the tub portion by the blower 210, the moist air is directed substantially into the inlet end 222 of the duct. FIGS. 2 and 3 illustrate an example of the inlet end 222 being in communication with the blower 210. In particular, FIG. 2 illustrates the inner facing side of the interior wall of the door assembly 250 in which the inlet 212 of the blower is visible. FIGS. 2 and 3 illustrate the outer facing side of the interior wall of the door assembly 250 with the majority of the duct 220 being visible and a portion of the inlet end 222 of the duct removed to allow the blower 210 to be visible for illustration purposes only.

Figure 5:
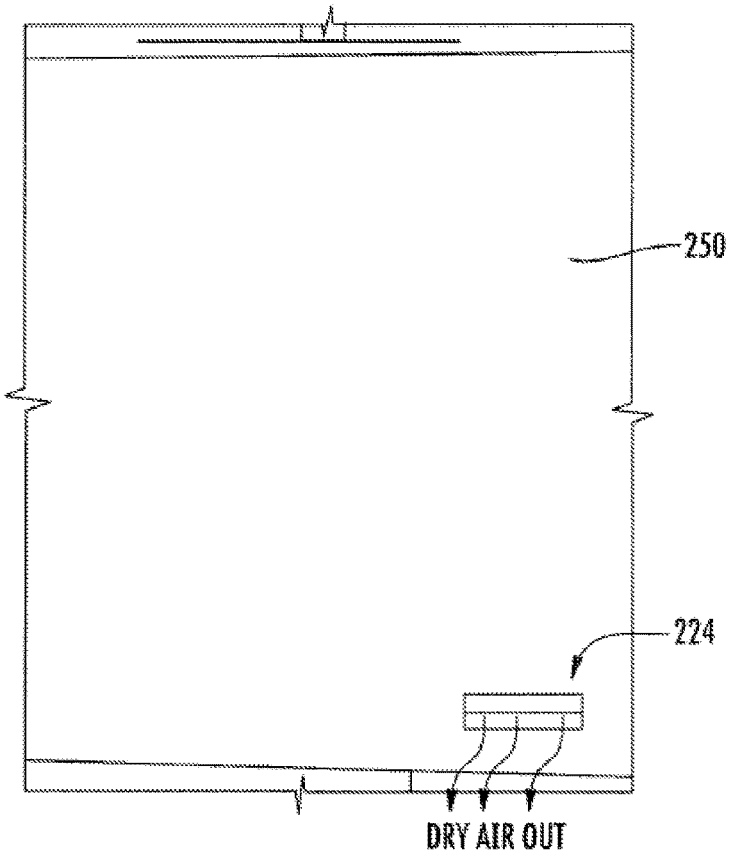
FIG. 5 is a view of an outer facing side of an outer wall of a dishwasher consistent with an exemplary embodiment of the present invention.
Figure 6:
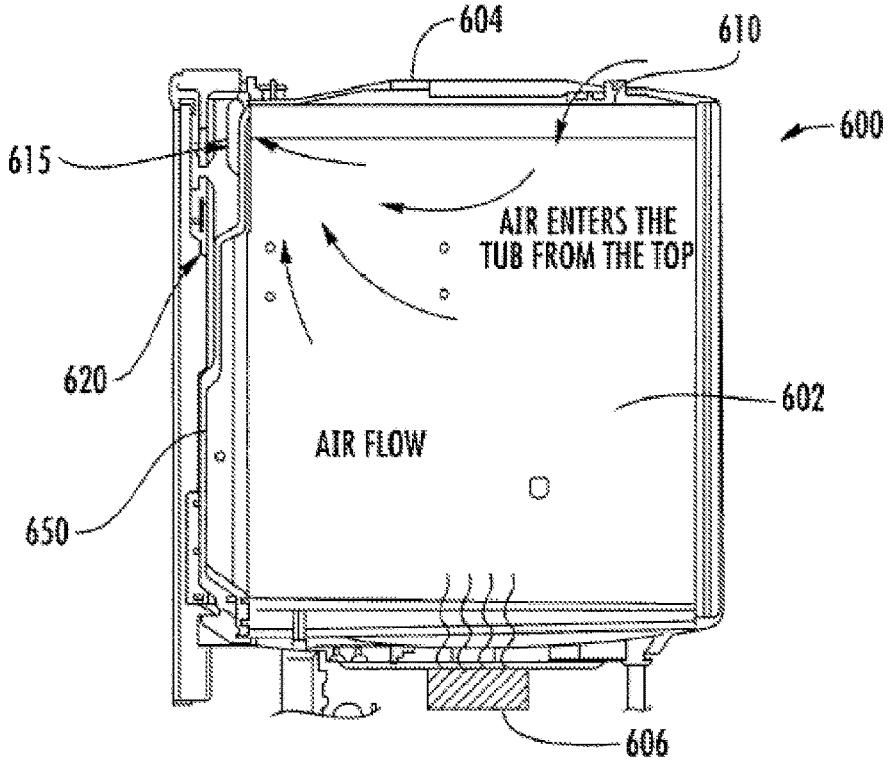
FIG. 6 is a cross-sectional side view of a dishwasher consistent with an exemplary embodiment of the present invention.

The duct 220 may include a plurality of ribs 228 configured to interact with the air as the air is drawn in from the tub portion by the blower 210. As the air passes through the duct 220, the ribs 228 create multiple surfaces for the air to interact with so as to remove moisture from the air. As such, the moist air condenses as it navigates through the ribs 228 of the duct 220. Proximate the outlet end 224, the duct 220 may be in communication with a drain opening 226 disposed proximate the bottom of the door assembly 250. The drain opening may be disposed on the interior wall or other interior portion of the door assembly 250 such that as the water condenses due to the ribs 228, the water flows through the duct 220, out of the drain opening, and into the bottom of the tub portion to be collected in the sump of the dishwasher. As the water is drained through the drain opening 226, the resultant "drier" air flowing through the duct 220 is directed to the outlet end 224 of the duct which may disposed on the outer wall or other outer portion of the door assembly 250, e.g., as illustrated in FIG. 5, such that the drier air (i.e., drier as a result from the condensation process) exits the dishwasher.

In another embodiment, a blower 610 may be disposed remotely from the duct 620. As an example and as illustrated in FIGS. 6 through 10, the blower 610 may be disposed in an upper wall 604 of the tub portion 602 and configured to draw air into the tub portion 602 from outside the dishwasher 600. A heating device or element 606, e.g., disposed in or proximate to the lower end of the tub portion 602, heats the air within the tub portion 602. As the air is heated, the air will rise to the upper end of the tub portion 602 collecting moisture along the way.

In at least some instances, these factors may combine to pressurize the air in the tub portion 602. Once pressurized the air is directed toward and into a housing 615 of the drying system. The housing 615 may be positioned proximate the top of the door assembly 650 such that an inlet of the housing is disposed on an interior wall or other interior portion of the door assembly 650 and in communication with a duct 620 extending from an inlet end to an outlet end within the door assembly.

Figure 10:
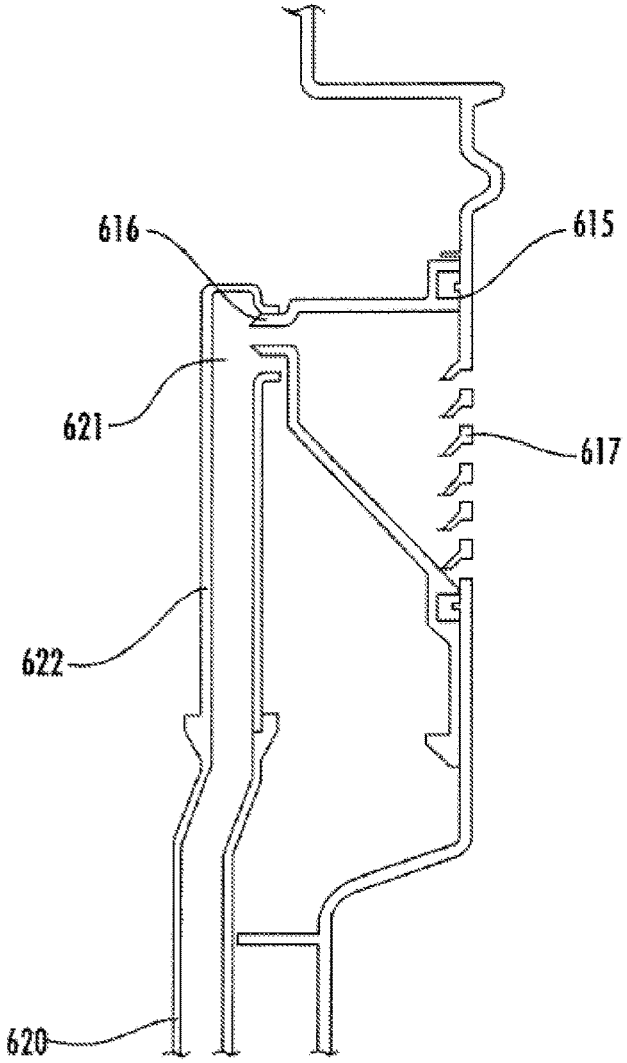
FIG. 10 is a cross-sectional view of a housing and an inlet end of a duct consistent with an embodiment of the present invention.
Figure 11:
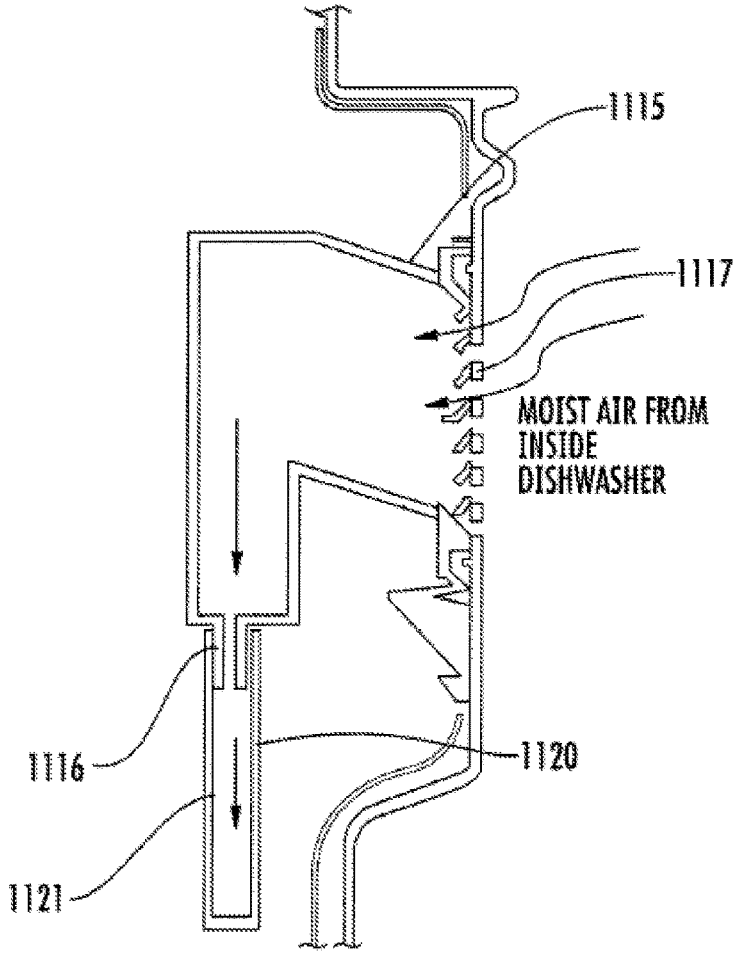
FIG. 11 is a cross-section view of a housing and an inlet end of a duct consistent with another embodiment of the present invention.

To facilitate the communication between the housing 615 and the duct 620 (i.e., the fluid transfer between the two), the housing 615 and the duct 620 may configured to connect together. FIG. 10 provides an example of such a configuration in which the housing 615 includes a projection 616 configured to engage a side opening 621 of the duct and, thus, connecting the housing 615 and the duct 620 together. FIG. 11 provides another example of such a configuration in which the housing 1115 includes a projection 1116 configured to engage a top opening 1121 of the duct and, thus, connecting the housing 1115 and the duct 1120 together.

As shown in both FIGS. 10 and 11, the housing 615, 1115 may include an inlet. The inlet may include a plurality of louvered fins 617, 1117 forming a barrier to minimize water (from spray or in the form of airborne droplets) from being pulled into the housing 615, 1115.

Figure 7:
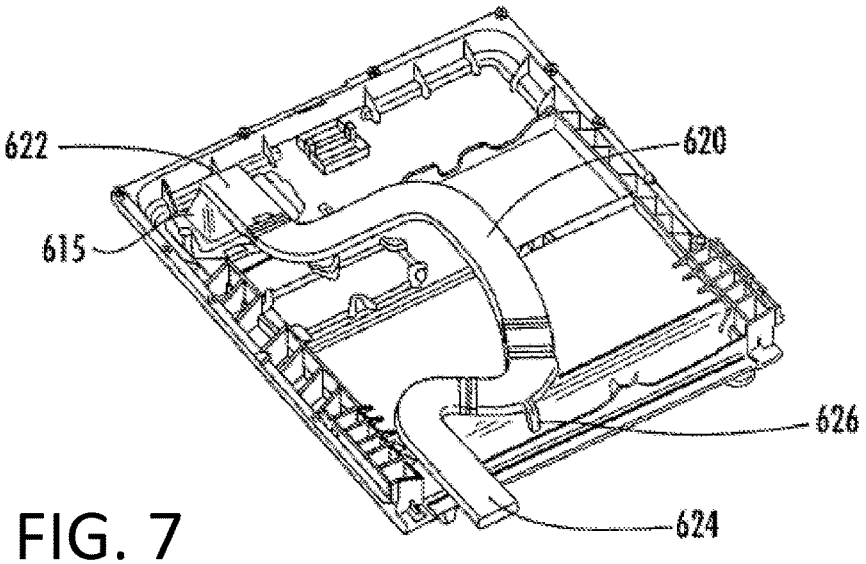
FIG. 7 is a perspective view of an outer facing side of an inner wall of the door assembly of the dishwasher of FIG. 6.
Figure 8:
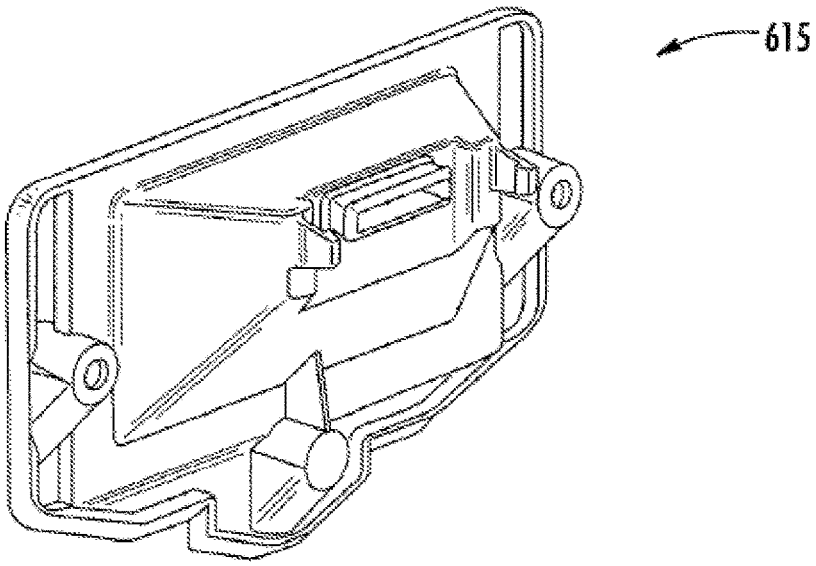
FIG. 8 is a perspective view of a housing according to FIG. 7.
Figure 9:
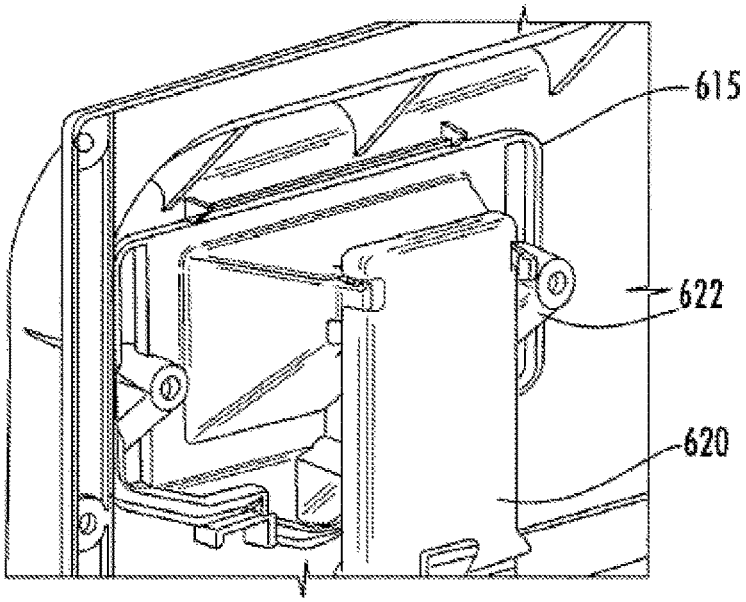
FIG. 9 is a perspective view of the housing and the inlet end of the duct according to FIG. 7.
Figure 12:
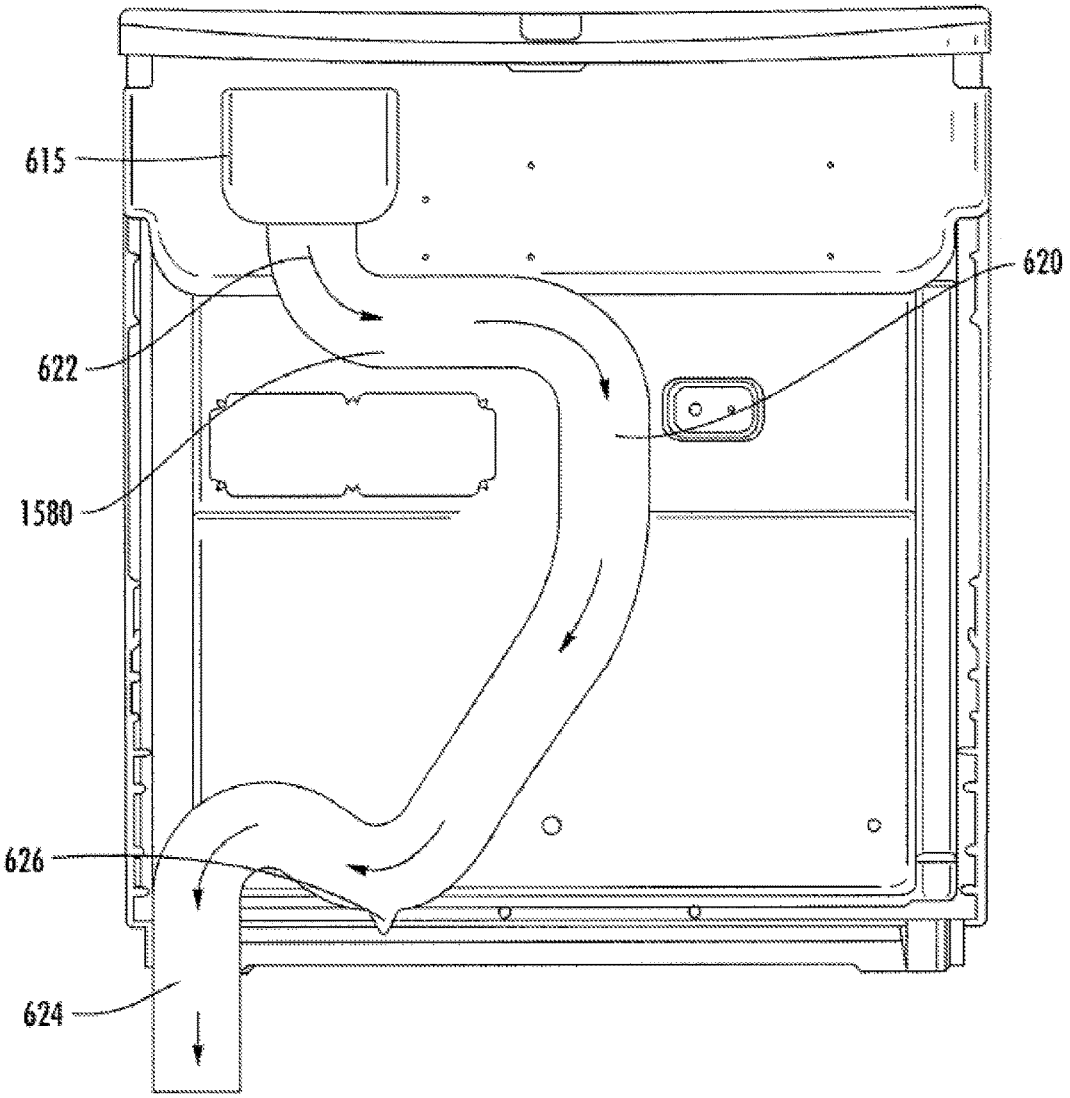
FIG. 12 is a frontal view of the outer facing side of the inner wall of FIG. 7.

Referring back to the duct 620, the duct 620 may extend from an inlet end 622 to an outlet end 624 for example as illustrated in FIGS. 7 and 12. In general, the duct is configured to condense the moisture from the air and direct the condensed moisture back into the tub portion and/or direct the drier air outside the dishwasher. For example, as explained above, the duct may include a plurality of ribs to create multiple surfaces for the air to interact with so as to promote condensation.

Instead of or in addition to the ribs, the duct 620 may be configured to traverse or extend along a tortuous path, in the plane of the door assembly, at least partially between the inlet and outlet ends. As used herein, a "tortuous path" means that the path includes multiple bends or turns and changes in directions, e.g., as illustrated in FIGS. 7 and 12. In this manner, the moisture-laden air interacts more with the walls defining the duct 620 than it would if the duct took a more linear path. This increased interaction with the walls increases the amount of moisture from the air that is condensed as the air travels through the duct 620.

The duct 620 may also include a drain port or opening 626, as shown in FIG. 12. More specifically, about a lowest, gravity-fed portion of the tortuous duct 620, the duct may define a drain opening or port configured to collect the condense moisture and direct the moisture back toward the bottom of the tub portion to be collected in the sump of the dishwasher.

Figure 13:
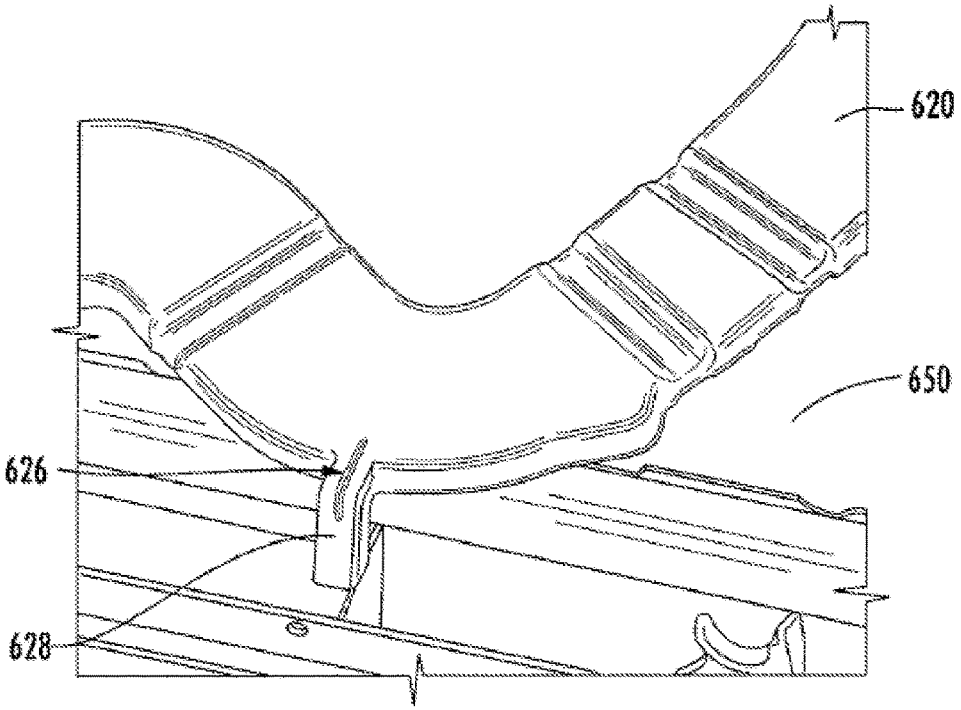
FIG. 13 is a partial enlarged perspective view of the duct and door assembly over FIG. 7.
Figure 14:
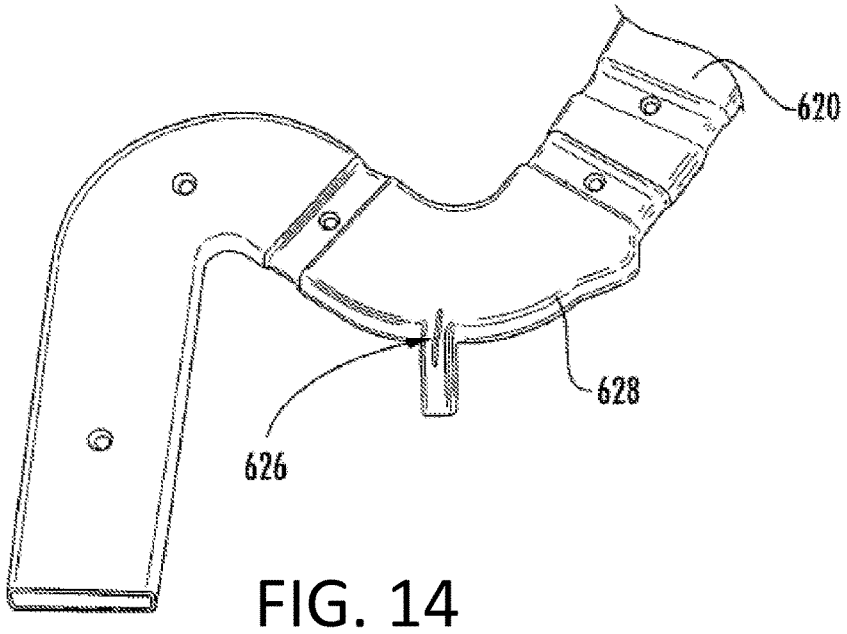
FIG. 14 is the partial enlarged perspective view of the duct of FIG. 13 without the door assembly.

The duct 620 may be further configured in a tortuous manner in a plane perpendicular to the plane of the door assembly 650, e.g., as illustrated in FIGS. 13 and 14. In particular, and as illustrated, the duct 620 may further include one or more portions 628 varying from the path of the duct 620, perpendicularly to the plane of the door assembly 650. In some instances, e.g., the illustrated embodiment of FIGS. 13 and 14, one such portion may be disposed on either side of the drain opening 626 defining a drain extension 628. The orientation or direction of the drain extension 628 is intended to lead the water back into the tub portion 602 (e.g., in instances, where a user may spill water into the duct with the door in an open position, the orientation of the drain extension 628 is intended to lead the spill water back toward the tub portion 602 rather than outside the dishwasher).

As noted above, the blower 210 may be positioned proximate the top of the door assembly 250 such that an inlet 212 of the blower is disposed on an interior wall or other interior portion of the door assembly 250. The blower 210 may be configured to draw or force warm air and water vapor from the tub portion toward the duct 220 inside of the door assembly 250. In various embodiments, the blower 210 may be cyclically actuated or pulsed on and off. For example, the blower may be selectively activated, pulsed, or cycled rather than being constantly on during the drying cycle. In various embodiments, a single blower 210 and/or a single fan may be used to facilitate drying of the dishware within the dishwasher. In one embodiment, the blower 210 is a centrifugal blower.

Figure 15:
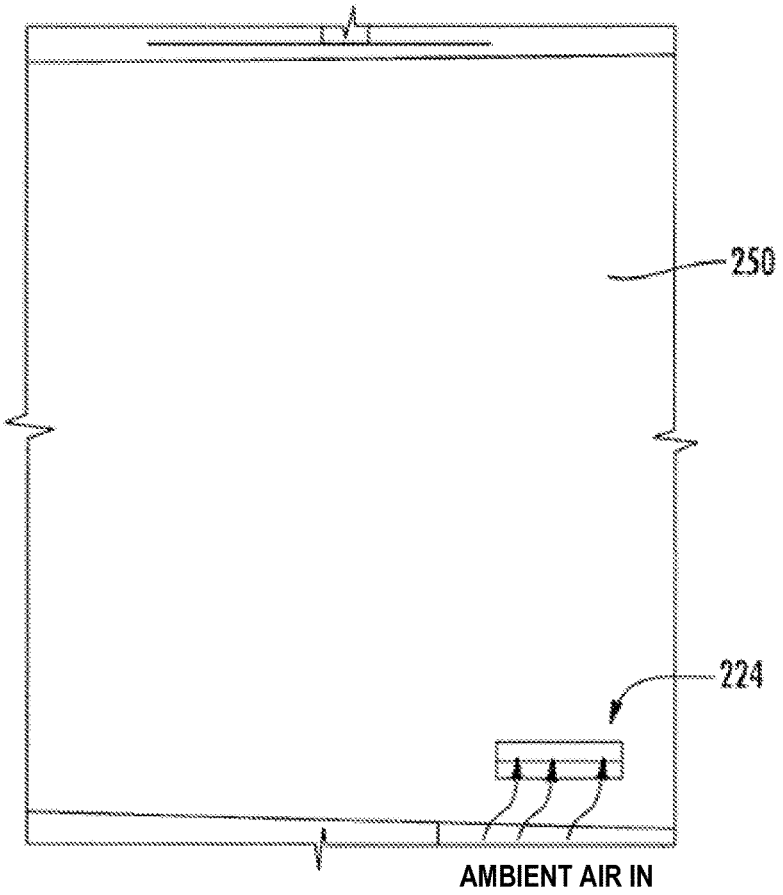
FIG. 15 is a view of an outer facing side of an outer wall of a dishwasher, in accordance with an embodiment of the present invention.
Figure 16:
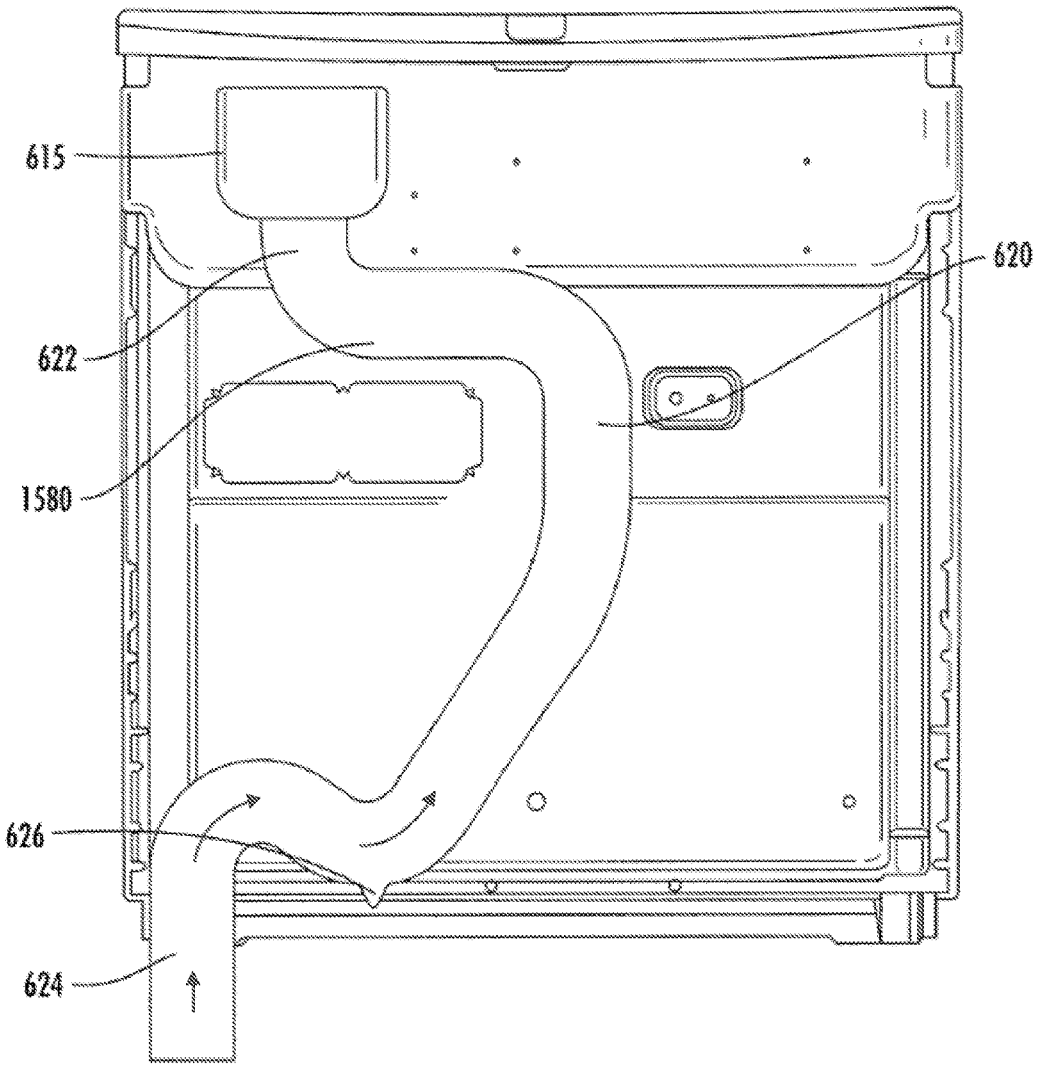
FIG. 16 is a frontal view of an outer facing side of the inner wall of FIG. 7, in accordance with an embodiment of the present invention FIGS. 17A, 17B, and 17C each illustrate a possible blower actuation pattern, in accordance with an embodiment of the present invention.

As described above, when the blower 210 is actuated, warm air and water vapor may be drawn into the inlet 212 of the duct 220. The water vapor may be condensed within the duct 220, and the warm dry air may exit the outlet 224 of the duct (e.g., shown in FIG. 5). When the blower 210 is not actuated (e.g., during the off portion of a blower cycle), ambient air from outside the dishwasher may enter the outlet 224 of the duct, such as shown in FIGS. 15 and 16. This may lead to the interaction of the warm air and water vapor with the ambient air within the duct 220. As the ambient air may be cooler and dryer than the warm air and water vapor, the interaction of the ambient air with the warm air and water vapor may accelerate the condensation of the water vapor within the duct. In various embodiments, the length of the off portion of the blower cycle may be shorter, longer, or the same length as the on portion of the blower cycle.

Figure 17A:
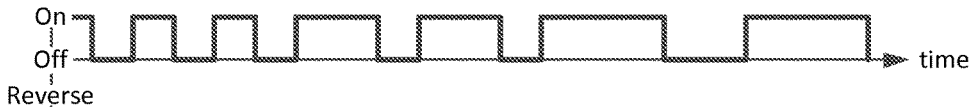

In various embodiments, the relative and/or actual lengths of the on and off portions of the blower cycle may be optimized to efficiently and/or quickly dry the dishware within the dishwasher. In some embodiments, the lengths of the on and off portions of the blower cycle may be predetermined. In some embodiments, one or more measurements of the humidity within the duct 220 and/or within the tub (e.g., with a humidity sensor) may be used to optimize the lengths of the on and off portions of the blower cycle, as described below. In various embodiments, the length of the on and/or off portions of the blower cycle may be on the order of seconds or minutes. FIG. 17A provides a graphic example of a blower operation pattern in a cyclic manner during a portion of a drying cycle in an example embodiment.

Figure 17B:
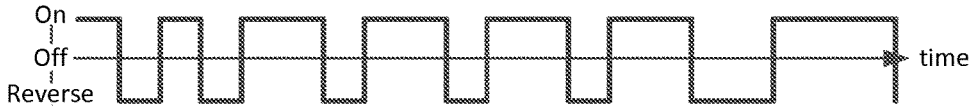

In various embodiments, operation of the blower in a cyclic manner may include reversing the direction of the blower. For example, the direction in which the fan of the blower spins may be reversed. As such, in some embodiments, blower operation pattern in a cyclic manner may include actuating the blower for a period of time such that warm air and water vapor from within the dishwasher is drawn into the inlet 212 of the duct 220 and then actuating the blower in a reverse direction for a period of time such that ambient air from outside of the dishwasher is drawn into the outlet 214 of the duct. In various embodiments, one blower may be used to alternatively draw warm air and water vapor from inside the dishwasher into the inlet 212 of the duct 220 and draw ambient air from outside the dishwasher into the outlet 214 of the duct. FIG. 17B provides a graphic example of a blower operation pattern in a cyclic manner during a portion of a drying cycle in another example embodiment.

Figure 17C:
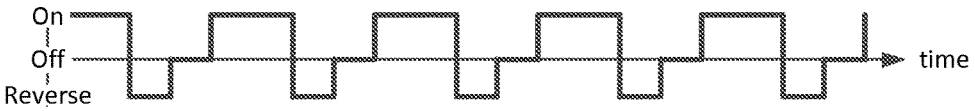

In various embodiments, operation of the blower in a cyclic manner my include actuating the blower in one direction for a first period of time, actuating the blower in a reversed direction for a second period of time, and then turning the blower off for a third period of time. In some embodiments, one blower and/or fan may be configured to draw warm air and vaporized water into the inlet of the duct, pause, and draw ambient air from outside the dishwasher into the outlet of the duct. FIG. 17C provides a graphic example of a blower operation pattern in a cyclic manner during a portion of a drying cycle in yet another example embodiment.

In various embodiments, the relative and actual lengths of the first, second, and third periods of time may vary between embodiments. In some embodiments the relative and/or actual lengths of the first, second, and third time periods may be optimized to efficiently and/or quickly dry the dishware within the dishwasher. In some embodiments, one or more humidity measurements (e.g., from a humidity sensor) may be used to optimize the lengths of the first, second, and third time periods. For example, the first, second, and third time periods may be configured to efficiently dry the dishware within the dishwasher. In various embodiments, the first, second, and third time periods are configured such that the temperature within at least a portion of the duct 220 stabilizes to the temperature of the ambient air during at least a portion of the blower cycle.

In various embodiments, the first, second, and third time periods may remain the same throughout the drying cycle, such as illustrated in FIG. 17C. In other embodiments, the first, second and third time periods may vary during the drying cycle based on a predetermined algorithm, the measured humidity within the duct and/or tub portion of the dishwasher, and/or the like, such as illustrated in FIGS. 17A and 17B. The illustrated blower actuation patterns are provided as examples of possible blower operation patterns. Various other blower operation patterns may be used to accomplish efficient drying of the dishware within the dishwasher. For example, the blower may be turned on, then turned off, then reversed, then turned back on. In other example, the blower may be turned on, then turned off, then reversed, then turned off, then turned back on. In some embodiments, the blower may only be cyclically or continuously actuated in a reverse direction.

Figure 18:
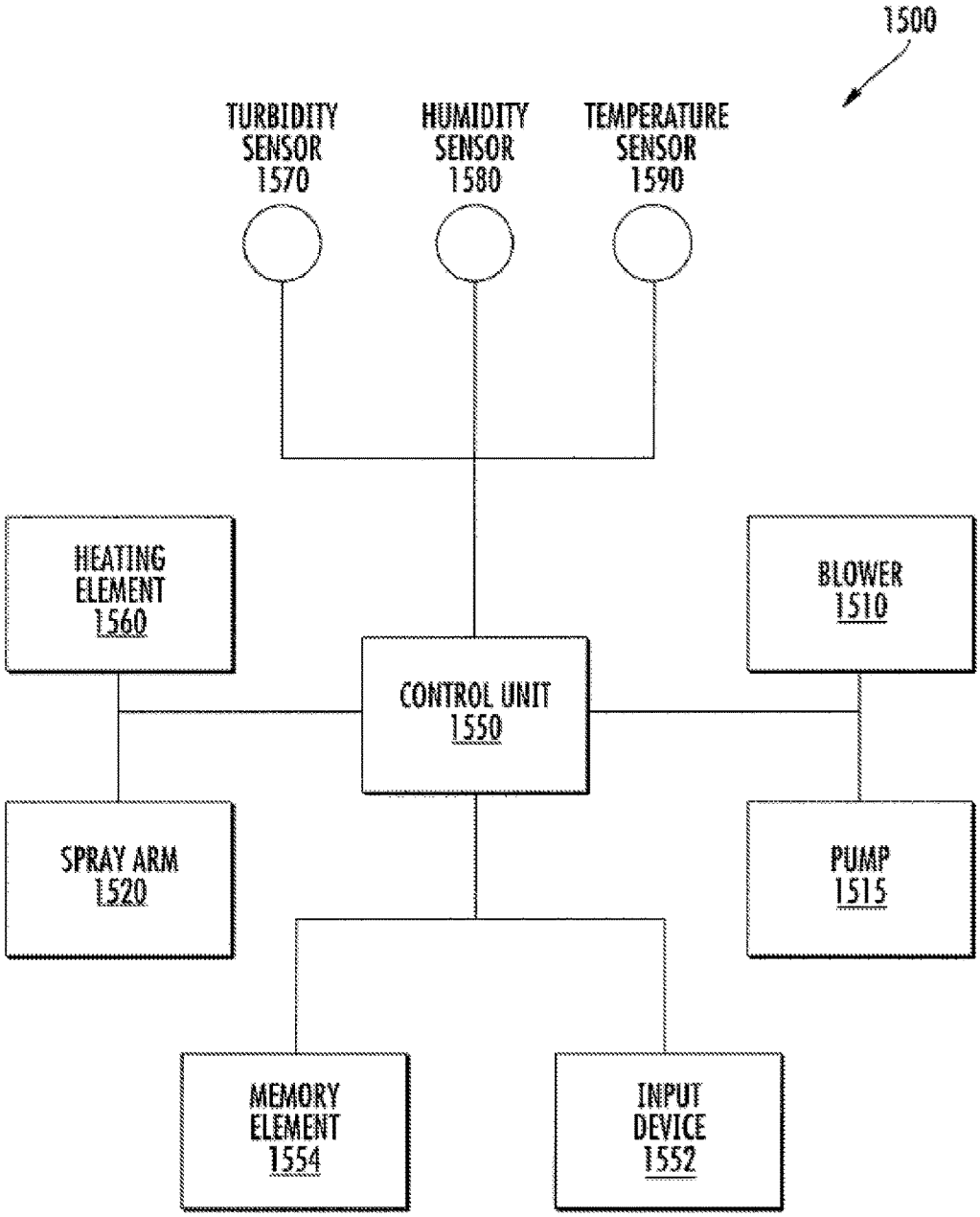
FIG. 18 is a block diagram of selective components of a dishwasher.

Embodiments of the dishwasher 1500 may further include a control unit 1550 and one or more sensors, e.g., as shown as a block diagram in FIG. 18. The control unit 1550 may be configured to control, adjust, and/or synchronize one or more of the operations of the dishwasher, at least partially, based on information received from the sensors. The control unit may be embodied as a processor(s), coprocessor(s), a controller(s) or various other processing means or devices including, without limitation, integrated circuits. Examples of sensors include, without limitation, a turbidity sensor 1570, a humidity sensor 1580, and a temperature sensor 1590. In general, a turbidity sensor is a device configured to measure the level of particulates (or simply referred to as the "dirtiness") of water or other liquids. A humidity sensor is a device configured to measure the amount of moisture in or relative humidity of a medium such as air. And a temperature sensor is a device configured to measure the temperature of a medium such as air or water. As explained above, components of the dishwasher may include, without limitation, one or more heating elements 1560, a blower 1510, a spray arm 1520, and a pump 1515. The control unit 1550 may be in electrical communication with the one or more sensors 1570, 1580, 1590 such the control unit 1550 receives information, e.g., level of dirtiness, level of humidity, and temperature. Based on the received information, the control unit 1550, which is in electrical communication with the components 1510, 1515, 1520, 1560 of the dishwasher, may send commands to one or more of the components 1510, 1515, 1520, 1560, e.g., turn on or off and/or increase or decrease an output. In addition to or instead of the sensors, the control unit 1550 may receive instructions or other information from an input device 1552, such as a control panel on the front side of the door assembly. The dishwasher 1500 may further include one or more memory elements 1554 for storing instructions (e.g., a software program) for the control unit 1550.

Figure 19:
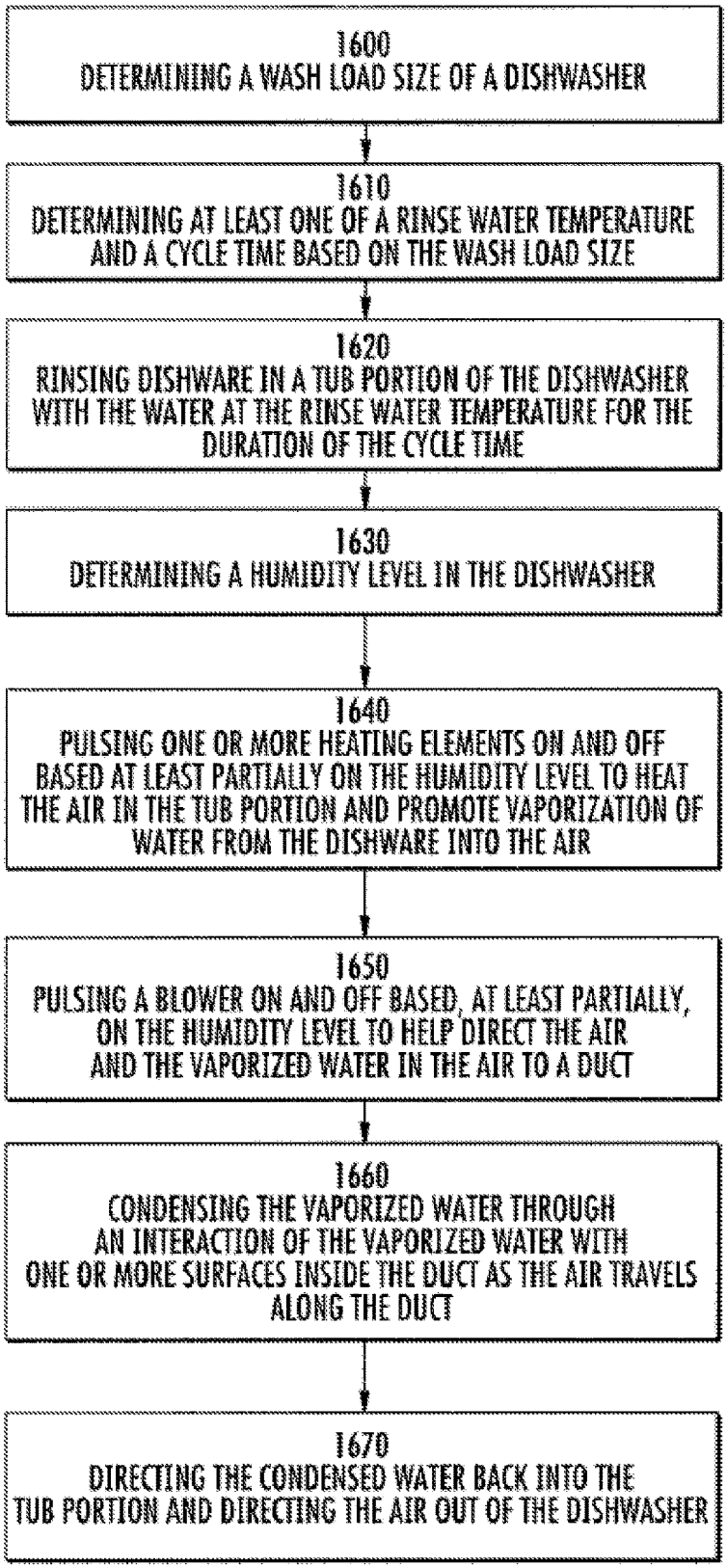
FIG. 19 is a flow chart illustration of a method according to an exemplary embodiment.

FIG. 19 illustrates an example of a method of drying dishware in a dishwasher that may be implemented by one or more of the embodiments disclosed herein. The method includes determining a wash load size of the dishwasher 1600. In general, the wash load size provides an approximation of the amount of soils that need to be removed from the dishware. The wash load size may be relatively large due to the amount of dishware (e.g., large number of plates and bowls) and/or the amount of soil that is on the dishware (e.g., the relative dirtiness of the dishware). Rather than provide an approximate value to the wash load size, embodiments may employ relative sizes, such as, small, medium, and large. According to an embodiment, the wash load size may be determined solely or at least partially through the measurement of the dirtiness or turbidity of the water in the tub portion or the sump. In general, more "soils" in the water indicates a larger wash load size. The turbidity of the water may be measured by a turbidity sensor, as explained above, either during a wash or rinse cycle. The location of the turbidity sensor may vary, e.g., the sensor may be in the sump or bottom portion of the tub portion. In another embodiment, instead or in addition to the turbidity sensor, the determination of the wash load size may rely on an input from an operator. For example, an operator may input a wash load size through an input device.

The method may further include heating water to a rinse water temperature. For example, the heated water may come from an external source such as, e.g., the water system of a house. The water may be heated as part of the water system, e.g., an external water heater, and/or be heated by one or more heating elements in the dishwasher. Rinsing the dishware with the heated water will heat the dishware to a dishware temperature based on the rinse water temperature, the wash load size, and the rinse cycle time. In general, the rinse water temperature has a direct relationship with the dishware temperature, i.e., the higher the rinse water temperature then the higher the dishware temperature. The wash load size provides an indication of the total thermal mass of the dishware. A greater wash load size generally indicates a greater thermal mass. The thermal mass of the dishware provides an indication of the time it may take to heat the dishware to a desired dishware temperature in that a larger thermal mass takes longer to heat then a small thermal mass. Therefore, it is believed that determining the wash load size helps to determine a preferred water rinse temperature and/or a preferred cycle time needed to obtain a particular dishware temperature and to effectively clean the dishware and/or effectively sanitize the dishware. In other words, the method may include determining at least one of a rinse water temperature and a cycle time based on the wash load size in order to obtain a preferred dishware temperature 1610 and rinsing the dishware in the tub portion of the dishwasher with the water at the rinse water temperature and for the duration of the cycle time 1620. In some embodiments, the final rinse water temperature may be limited or fixed due to the limitations of the external water and heating elements of the dishwasher or the water system and, thus, in some embodiments, only the cycle time may be adjusted according to the wash load size. It should be understood that the determination of the preferred rinse water temperature and/or the cycle time based on the wash load size may apply to one or both of the wash and rinse cycles.

As illustrated in FIG. 19, the method may also include determining a humidity level in the dishwasher 1630. According to an embodiment, the humidity is measured by a humidity sensor located in the duct (e.g., as illustrated in FIG. 12, wherein the humidity sensor is represented by 1580). It is believed that inside the duct is a preferred location for the humidity sensor because the environment inside the duct has a relatively low level of water or liquid compared to the tub portion and sump. It is also believed that the level of humidity in the duct provides an indication of how dry the dishware is in the tub portion. For example, after the cleaning and rinse cycles, the surfaces of the dishware may be wet. Therefore, as explained herein, as the air is heated during the dry cycle, the water on the surfaces of the dishware may start to evaporate or vaporize into the air in the tub portion such that as the air and vaporized water enters in the duct, the measured humidity will be relatively high. As the dishware starts to dry, less and less water will be vaporized into the air and, thus, the air entering the duct will contain less vaporized water and the measured humidity will be less. Once the humidity level reaches a certain minimal level, the dishware may be considered dry and the drying cycle may stop, i.e., the method may further include ending the pulsing or cyclically actuating of the one or more heating elements and the blower upon the humidity level reaching a minimum level as discussed further herein.

As part of the drying cycle, the method may include cyclically actuating one or more heating elements on and off based, at least partially, on the humidity level to heat the air in the tub portion and promote vaporization of water from the dishware to the air 1650 and pulsing a blower on and off based, at least partially, on the humidity level to help direct the air and the vaporized water in the air to a duct 1660. "Pulsing" or "cyclically actuating" generally means selectively activating or cycling the blower and the heating elements rather than constantly having these components on. The humidity level and, in some embodiments, the determined wash load size, may be used, for example, by the control unit to determine the preferred cycles or activation periods for the components. For example, the pulsing of the heating elements is configured to provide the requisite or optimal heat to a tub portion of the dishwasher in order to evaporate or vaporize water residual left on the dishware, i.e., to help dry the dishware, while conserving energy compared to if the heating elements were constantly on. The pulsing of the blower is configured to provide additional air from outside the dishware in order to help pressure the tub portion or to otherwise encourage the air containing the water vapor toward the duct.

The method may further include condensing the vaporized water through the interaction of the vaporized water and one or more surfaces inside the duct (e.g., due to a tortuous path of the duct and/or fins or ribs in the duct) as the air travels through the duct 1660. The method may further include directing the condensed water back into the tub portion and directing the drier air resulting from the condensation process out of the dishwasher 1670.

The above embodiment, through the determination of wash load size and the relative humidity or level of humidity in the duct, allows the control unit to optimize the drying cycle in that it can control the operations of the blower and the heating elements selectively and thereby conserve energy while drying the dishware in the tub portion.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher configured to perform at least one washing program, the at least one washing program comprising a drying cycle, the dishwasher comprising:

a tub defining an opening and an interior;

a door attached to the tub and configured to selectively permit access to the interior of the tub;

at least one washing element configured to wash dishware disposed within the tub;

a duct positioned within the door, the duct having an inlet that is in fluid communication with the interior of the tub and an outlet that is in fluid communication with an external environment, the duct extending from the inlet to the outlet, wherein the duct is configured to receive warm air and vaporized water from within the tub;

a blower configured to direct the warm air and vaporized water into the duct during at least a portion of the drying cycle of the at least one washing program; and a control unit configured to operate the blower in a selectively activated manner during the drying cycle, wherein operating the blower in the selectively activated manner comprises:

activating the blower in a direction wherein the warm air and vaporized water are directed into the inlet and deactivating the blower, wherein the activating and deactivating the blower occur a plurality of times during the drying cycle;

at least one time during the drying cycle, alternating between activating the blower a) in the direction where the warm air and vaporized water are directed into the inlet, and b) in a reversed direction of operation wherein ambient air from the external environment is drawn into the duct via the outlet to interact with the vaporized water within the duct to accelerate the condensation of the vaporized water.

2. The dishwasher of claim 1, wherein the duct is configured to provide a path for the warm air and vaporized water to travel from the inlet toward the outlet.

3. The dishwasher of claim 1, wherein the control unit is further configured to cause the alternating of the blower to occur a plurality of times during the drying cycle.

4. The dishwasher of claim 1, wherein the duct at least partially defines a tortuous path, wherein the tortuous path is configured to facilitate condensation of vaporized water from warm air as the warm air and vaporized water are directed through the duct.

* * * * *